United States Patent [19]

Stoner

[11] Patent Number: 4,770,098

[45] Date of Patent: Sep. 13, 1988

[54] TELESCOPED AMMUNITION ROUND

[75] Inventor: Eugene M. Stoner, Palm City, Fla.

[73] Assignee: Ares, Inc., Port Clinton, Ohio

[21] Appl. No.: 70,164

[22] Filed: Jul. 3, 1987

Related U.S. Application Data

[63] Continuation of Ser. No. 719,520, Apr. 3, 1985, abandoned.

[51] Int. Cl.[4] ..... F42B 5/02

[52] U.S. Cl. ..... 102/434; 102/466

[58] Field of Search ..... 102/430, 433, 434, 438, 102/464, 465, 466, 467

[56] References Cited

U.S. PATENT DOCUMENTS

| | | | |
|---|---|---|---|
| 2,996,988 | 8/1961 | Kunz | 102/433 |
| 3,009,394 | 11/1961 | Kamp et al. | 102/434 X |
| 3,935,816 | 2/1976 | Boguette, Jr. | 102/466 |
| 4,220,089 | 9/1980 | Smith | 102/434 |
| 4,335,657 | 6/1982 | Bains | 102/443 |
| 4,565,131 | 1/1986 | Buchner | 102/466 |

FOREIGN PATENT DOCUMENTS

| | | | |
|---|---|---|---|
| 747764 | 5/1970 | Belgium | 102/433 |

*Primary Examiner*—Harold J. Tudor
*Attorney, Agent, or Firm*—Allan R. Fowler

[57] ABSTRACT

A telescoped ammunition round utilizing nonstrategic materials is light-weight and enables the use of conventional particulate propellants as well as conventional components such as projectiles and primers if desired. Webs molded into the case interior facilitate molding of the case and provide for supporting the projectile therein before and during the loading of particulate propellant into the case. In addition, the webs are operative for decreasing the longitudinal resistance of the case thereby reducing inward movement of the primer when struck by a firing pin thereby reducing the possibility of misfire. The projectile is prevented from debulleting during handling and is provided with preselected shot-start characteristics by an opening formed through the cap and a plurality of holes formed in the cap to provide proper resiliency in the cap for holding the projectile before firing and retarding the projectile momentarily upon firing.

5 Claims, 1 Drawing Sheet

TELESCOPED AMMUNITION ROUND

This application is a continuation of application Ser. No. 06/719,520 filed Apr. 3, 1985, now abandoned.

The present invention generally relates to ammunition for small arms weapons and is more particularly directed to an inexpensive telescoped ammunition round having less weight and smaller size than a corresponding conventional ammunition round of the same calibre. Further, the present invention utilizes many non-metallic components, thus substantially reducing the need for strategic materials such as copper.

Most designs of small calibre weapons are based on technology having origin as early as early 1900's.

Many improvements have been made in ammunition for these weapons, many of which have been directed to projectiles modifications for specific targets. However, most of these improvements have been limited by existing gun mechanisms and ammunition handling equipment.

Conventional ammunition rounds for small arms weapons, such as 50-calibre machine guns and the like, typically utilize brass cartridge cases. The amount of copper in the world and its availability at times is limited. Despite the fact that conventional brass cartridge cases may be suitable for reloading, the fact is that none are so reloaded when used in actual combat.

Aside from the strategic nature of copper, it has additional disadvantages in that its weight is a significant portion of the overall weight of a conventional ammunition round. In addition, in order to manufacture a conventional cartridge case, significant manufacturing tooling is required.

The concept of telescoped ammunition is not new. Telescoped ammunition generally includes rounds in which a projectile is totally enclosed within a cartridge case. The cartridge case may have an outer shape, or envelope, of a right cylinder. This envelope provides for more efficient and compact storing of the ammunition rounds and further enables a gun mechanism utilizing the telescoped ammunition to be shorter and lighter.

In addition to significantly reducing the combat weight of a gun mechanism, the gun mechanism may be made with fewer moving parts, which, in turn, offers increased reliability and facilitates maintainability thereof.

Heretofore, telescoped ammunition round technology has been directed to developing high performance in terms of projectile penetration and velocity and generally incorporated a totally new projectile design and exotic configurations of solid propellant molded for supporting the projectile within the cartridge case.

The present invention may utilize standard projectiles such as a 50 calibre M33 projectile as well as a standard M33 primer and conventional particulate propellant.

SUMMARY OF THE INVENTION

In accordance with the present invention, a telescoped ammunition round includes a projectile, particulate propellant, a case having an open end and web means disposed within the case for both supporting the projectile within the case, and for enabling the particulate propellant to be poured into the case and around the projectile through the case open end.

Additionally, means are provided for sealing the case open end and primer means is disposed in an operational position for igniting the particulate propellant.

Of particular importance is the fact that the projectile is supported within the case by the webs therein prior to the filing of the case with the particulate propellant as this enables use of conventional type particulate propellant.

More particularly, the means for sealing the case open end include a cap fitted to the case open end with an opening therethrough which is coaxially aligned with the projectile. Additionally, the cap includes a rupturable seal across the opening therein for preventing contamination of the ammunition round while allowing the projectile to pass through the opening upon firing of the particulate propellant. In addition, the cap functions to provide preselected shot-start characteristics to the projectile.

The case and cap are formed, as by injection molding, from a non-metallic material such as glass filled Lexan brand polycarbonate.

Manufacture of the case is facilitated by the fact that the webs are molded into the non-metallic case during the injection molding and a notch molded into the webs provides means for supporting the rear end of the projectile within the case and the cap.

An additional feature of the webs is that they also act as runners during injection molding of the case to facilitate filling of the mold with material. This enhances the moldability of the case and ensures complete filling of the mold thereby reducing the number of defects therein.

The web means are also operative for decreasing the flexibility of the case by forming the webs from a case end, opposite the case open end, to a point proximate the case open end. In this manner, the webs decrease the longitudinal resiliency of the case thereby reducing inward movement of the primer when the primer is struck by the firing pin.

This reduced inward movement provides sufficient stiffness required by the primer in order to ignite after being struck by a firing pin. This configuration, therefore, has the advantage of reducing the possibility of misfire of the primer and subsequent non-firing of the particulate propellant.

The projectile, which may be a standard M33 50 calibre projectile is supported within both the case and the cap opening in order to substantially reduce the overall length of the ammunition round.

In a preferred embodiment of the invention to prevent premature forward movement of the projectile through the cap opening, means are provided including a wall of a cap opening and means defining a plurality of holes in the cap, which are disposed between the wall opening and an outer wall of the cap.

These holes provide a resiliency in the opening wall to enable the opening to have a diameter smaller than the outside diameter of the projectile. When the cap is assembled on the case, the cap opening wall bears against an ogive of the projectile, thereby preventing forward movement of the projectile through the opening before ignition of the particulate propellant. In addition, the plurality of holes also contribute in providing preselected shot-start characteristics to the projectile.

A BRIEF DESCRIPTION OF THE DRAWINGS

The advantage and features of the present invention will be better understood by the following description, taking into conjunction with the accompanying drawings, in which.

DETAILED DESCRIPTION

Figure 1:
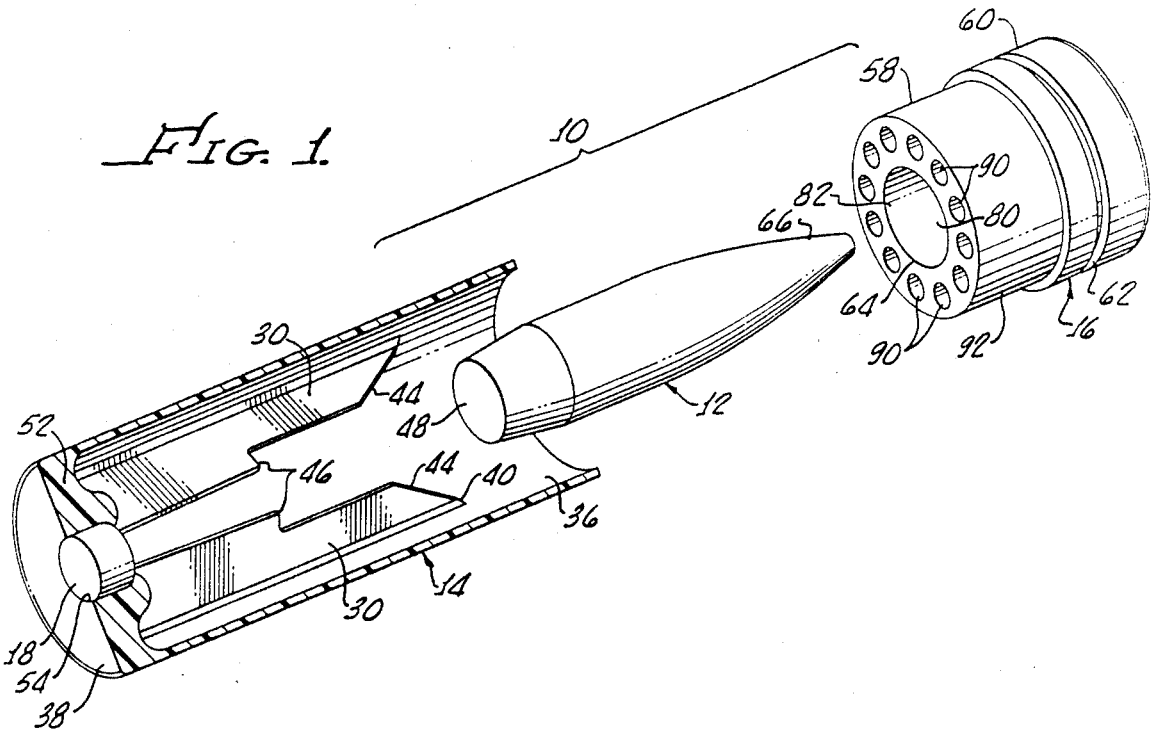
FIG. 1 is an exploded prospective view of an ammunition round in accordance with the present invention, generally showing the projectile, a cartridge case and webs molded into the case for supporting the projectile within the case, a cap and a primer.

Turning now to FIG. 1, there is shown a telescoped ammunition round 10 in accordance with the present invention, generally showing a projectile 12, a case 14, a cap 16 and a primer 18.

While the principles of the present invention may be utilized, by scaling, to various small arm sizes including combat rifles, it is herein-described in connection with a standard calibre 0.50 M33 machine gun projectile 12, and a standard M33 primer 18.

Figure 3:
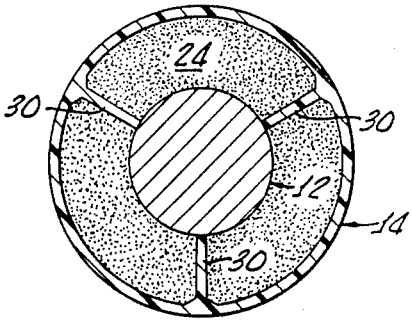
Figure 2:
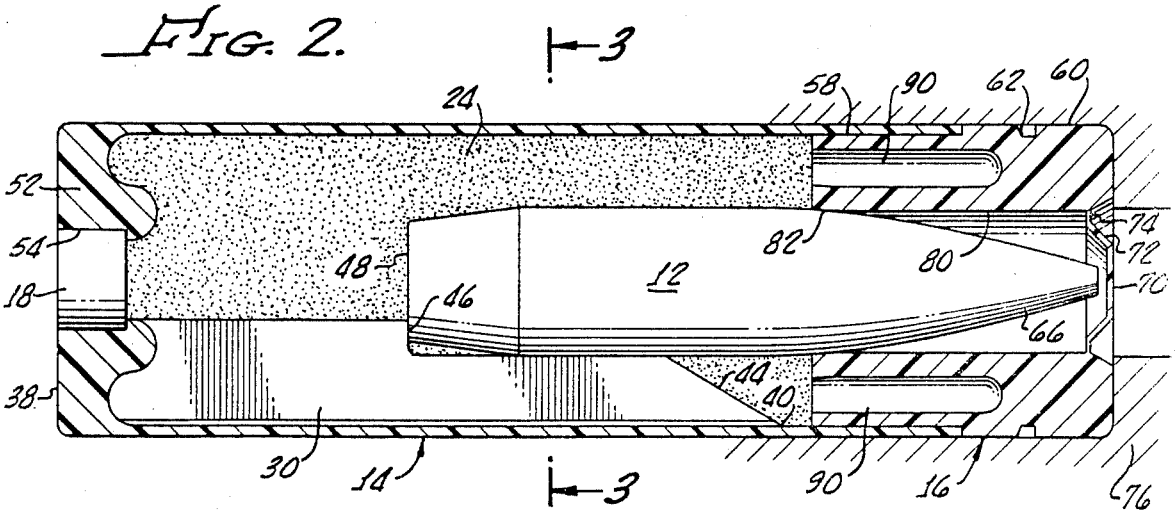
FIG. 2 is a cross-section of an assembled ammunition round in accordance with the present invention; and, FIG. 3 is a cross-section of the ammunition round taken along line 3—3 of FIG. 2.

As is most evident in FIGS. 2 and 3, the overall envelope of the ammunition round 10 is that of a right cylinder, thus, unlike a conventional calibre 0.50 M33 machine gun round having a projectile protruding from a case (not shown) significant size advantage is attained.

For example, the overall length and width of the projectile 10, in accordance with the present invention, utilizing a standard M33 projectile may be 3.5 inches (8.9 centimeters) and one inch (2.5 centimeters), respectively. In contrast, a conventional calibre 0.50 M33 round has an overall length of about 5.5 inches (14 centimeters) and a case which has a base width of about 0.81 inch (2.06 centimeters) which tapers towards a forward end thereof and is necked down for supporting the projectile (not shown).

It should be readily apparent that the right cylinder configuration of the ammunition round made in accordance with the present invention facilitates storage thereof more efficiently and compactly than with conventional ammunition rounds, thereby reducing the size and weight of ammunition containers.

Both the cartridge case 14 and cap 16 may be injected molded from a non-metallic material such as, for example, glass-filled Lexan brand polycarbonate. Utilizing this light-weight material results in a savings of up to one-half on the weight of combat loaded, box, linked ammunition. Thus, the resulting light-weight of the ammunition round 10 provides for more rounds of the ammunition for the same combat weight.

In addition, the use of strategic metals such as copper for the cartridge cases eliminated and the overall cost of the ammunition round 10 is estimated to be one-third or less the cost of a round of conventional brass-cased ammunition.

The ammunition round 10 may utilize a standard single-based IMR 4831-H propellant which is compatible with glass filled Lexan brand polycarbonate. Although any number of moldable plastic materials may be utilized for the cartridge case 14 and cap 16, propellant compatibility is to be taken into consideration. For example, double-based ball propellant which contains the nitroglycerine, is not necessarily compatible with all plastics.

Webs 30 may be molded in the interior 32 of the case 30 for both providing means for supporting the projectile 12 within the case 14 and for enabling the particulate propellant 24 to be poured into the case 14 and around the projectile 12 through a case open end 36.

These webs 30 enable the use of a conventional propellant such as IMR 4831-H instead of a solid cast propellant heretofore used in telescoped ammunition.

In addition, the webs 30 are further operative for decreasing the longitudinal resilience of the case 14 to reduce inward movement of the primer 18 when the primer is struck by a firing pin (not shown) thereby reducing the possibility of misfire of the primer 18.

It is well known that the conventional primer must be sharply struck to enable ignition thereof. While problems associated with small movement of the primer in conventional brass cases is not significant because of the secure mounting of the primer therein and the overall mass of the conventional ammunition round, the light-weight nature of the case in accordance with the present invention may exhibit some resilience along the longitudinal axis thereof, if not further strengthened by the webs 30, which extend from a base 38 of the case 14 to a position 40 proximate the open end 36 of the case 14.

Because the webs 30 extend almost the entire length of the case 14, they function to guide fluid Lexan plastic throughout the case mold (not shown) in order to ensure filling of the case mold. Hence, the webs act as conduits, or runners, to facilitate molding of the nonmetallic case 14 which reduces the number of defective cases which may be caused by such inadequate filling of the mold.

Also, the webs 30 provide additional transverse, or radial, strength to the case, thus enabling the case to be of thinner wall construction.

A tapered portion 44 may be formed in each of the webs 30 in order to facilitate the insertion of the projectile therebetween and to facilitate the loading of particulate propellant into the case after the projectile is so positioned therein.

Each of the webs 30 includes a notch 46 therein which provides means for supporting a rear end 48 of the projectile 12. Thus, as best seen in FIG. 2, the webs 30 are structural members having portions interposed directly between the primer 18 and the rear end 48 of the projectile 12, whereby to better oppose movement of the primer responsive to being struck by a firing pin (not shown). As can be seen, the webs extend from the base 38 at the rear end of the case longitudinally along the interior wall of the case to a position 40 proximate the open front end of the case.

Also molded on the interior 32 of the case 14 at the base 38 thereof is a support 52 having a hole 54 therein sized for compression fitting of the primer 18 therein.

It should be readily apparent that in the assembly of the ammunition round 10, the case 14 is held in a generally upright position with the projectile 12 placed therein and supported in a coaxial central position by the internal structural webs 30 and by the notches 48 in the webs 30. Thereafter, the particulate propellant 24 is poured through the open end 36 of the case 14 after which the cap 16 is inserted into the open end 36 of the case.

The cap 16 has a rear end 58 sized for insertion into the open end 36 of the case 14, and a forward end 60 having a diameter equal to the diameter of the case 14.

A notch, or groove 62, may be formed in the forward portion to facilitate handling of the ammunition round through the use of ammunition clips (not shown).

The cap 16 has an opening 64 which is coaxially aligned with the case 14 and projectile 12 to enable a front end 66 of the projectile to be disposed therein when the cap is assembled onto the case 14 and sized for enabling the projectile 12 to pass therethrough upon firing of the particulate propellant 24.

As shown in FIG. 2, the cap 12 includes a rupturable seal 70 across the opening 64 at the front end 60 thereof, the seal being molded therein so that the cap may be inexpensively produced.

This seal 70 prevents solid and liquid contamination from entering the cap and ammunition round which may interfere with proper movement of the projectile down a barrel 76 upon firing of the ammunition round.

The seal 70 may have a front portion 72 which is interconnected to the remainder of the cap 12 by connecting member 74, with the latter having a thickness less than the front portion 70 to enable controlled rupturing of the seal, thereby enabling the front portion 70 to be blown out the gun barrel 76 as the projectile 12 passes through the cap 16. In this manner, there is less likelihood of the seal 70 interfering with the motion of the projectile upon firing.

An inner wall 80 of the cap 16 includes a portion 82 thereof for engaging the ogive of the projectile 12 when the ammunition round 10 is assembled, which secures the projectile 12 within the case 14 and cap 16 and prevents premature forward movement of the projectile through the cap opening. Snuggly held within the case and cap 16, the projectile 12 will not move during handling and loading of the ammunition.

In order to so hold the projectile within the case 14 and cap 16 in a firm manner, a plurality of holes 90 are provided in the cap rear end 58 between the inner wall 80 and an outer wall 92 of the cap. These holes 90 provided resiliency in the cap to enable the opening 64 therein to have a diameter smaller than the outside diameter of the projectile.

As shown in FIG. 2, the engagement surface 82 is forced outwardly to a small extent when the cap is assembled on the case 14.

Additionally, the cap provides the shot-start characteristic to the projectile upon firing.

As is well known, the projectile 12 may be retarded in its initial forward movement after ignition of the propellant 24 in order to provide proper confinement of the exploding propellant and controlled movement and engraving of the projectile 12 into the barrel lands and grooves (not shown). This controlled initial movement is generally known as the shot-start characteristics of the projectile. In the past, this has been accomplished by crimping of the conventional projectile (not shown) into a conventional case (not shown).

In the present invention, the cap 16 with the coaxial opening 64 not only functions to hold the projectile 12 in position within the case 14 during handling to prevent debulleting, but additionally holds the propellant 12 within the case 14 momentarily after firing of the propellant (shot-start characteristic).

By varying the diameter of the opening 64 as well as the size and diameter of the holes 90, proper shot-start movement can be provided. It should be appreciated that these parameters may vary according to the type of propellant, projectile, as well as the materials utilized in the case 14 and cap 16.

Although there has been hereinabove-described a specific arrangement of a telescoped ammunition round in accordance with the present invention for purposes of illustrating the manner in which the invention may be used to advantage, it should be appreciated that the invention is not limited thereto. Accordingly, any and all modifications, variations or equivalent arrangements which may occur to those skilled in the art should be considered to be within the scope of the invention as defined in the appended claims.

What is claimed is:

1. A telescoped ammunition round comprising:

(a) a projectile having a rear end surface generally transverse to the longitudinal axis of the projectile and an ogive;

(b) particulate propellant;

(c) a one piece substantially hollow case of plastic material in the form of a right circular cylinder having an interior side, an exterior side, and an open forward end;

(d) a base formed in the rear end of the case;

(e) a primer centrally mounted in said base, with the primer and base closing the rear end of the case;

(f) said case having a plurality of integral internal structural webs formed therein of the same plastic material as the case, and extending longitudinally from the base to a position proximate the forward open end of the case;

(g) such webs having portions which abut the interior side of the case from the base of the case to a position proximate the forward open end of the case, and further having portions which abut the rear end surface of the projectile, and such webs being shaped to support the projectile within the case in a coaxial position enabling the particulate propellant to be poured into the case and around the projectile through the case open end;

(h) a separate plastic cap fitted to the case open end;

(i) the cap having a cylindrical opening therethrough which is coaxially aligned with the projectile, and into which the forward end of the projectile extends; and (j) means located on said cap for engaging the ogive of the projectile for preventing premature forward movement of the projectile within the case.

2. The apparatus of claim 1, wherein the means for preventing premature forward movement of the projectile comprises the wall of the coaxial opening at the rear end of the cap in engagement with the ogive of the projectile, said opening having an internal diameter which is slightly smaller than the outside diameter of the projectile.

3. The apparatus of claim 1, wherein the structural webs have portions interposed directly between the primer and the rear end surface of the projectile, whereby to better oppose movement of the primer responsive to being struck by a firing pin.

4. The apparatus of claim 1, wherein the structural webs taper into the case proximate the open end thereof, to facilitate insertion of the projectile and loading of the propellant.

5. The apparatus of claim 2, wherein the cap has a rupturable seal formed forward of the means for preventing premature forward movement of the projectile and sealing the opening in said cap.

* * * * *